United States Patent [19]

Schierling et al.

[11] Patent Number: 4,700,668

[45] Date of Patent: Oct. 20, 1987

[54] METHOD OF INJECTING FUEL FOR TWO-STROKE ENGINE AND APPARATUS THEREFOR

[75] Inventors: Roland Schierling, Affalterbach; Werner Geyer, Waiblingen; Michael Wissmann, Schorndorf-Weiler; Hans Nickel, Cottenweiler, all of Fed. Rep. of Germany

[73] Assignee: Andreas Stihl, Waiblingen, Fed. Rep. of Germany

[21] Appl. No.: 875,407

[22] Filed: Jun. 17, 1986

[30] Foreign Application Priority Data

Jun. 19, 1985 [DE] Fed. Rep. of Germany ..... 3521772

[51] Int. Cl.[4] ..... F02B 33/04

[52] U.S. Cl. ..... 123/73 C; 123/504; 123/447

[58] Field of Search ..... 123/73 AD, 73 C, 73 CB, 123/504, DIG. 5, 27 GE, 575, 447; 417/395, 384, 383, 401

[56] References Cited

U.S. PATENT DOCUMENTS 4,471,728 9/1984 Borst et al. ..... 123/73 AD
4,551,076 11/1985 DuBois ..... 123/DIG. 5
4,552,101 11/1985 Borst et al. ..... 123/DIG. 5

*Primary Examiner*—Craig R. Feinberg
*Assistant Examiner*—David A. Okonsky
*Attorney, Agent, or Firm*—Walter Ottesen

[57] ABSTRACT

The invention is directed to a method of fuel injection for two-stroke engines, especially for hand-operated tools such as motor-driven saws and the like. The fuel-injection pump is charged with pressure present in the crankcase thereby causing fuel to be pumped for injection and combustion in the engine. The injection operation is triggered and the onset of injection into the combustion chamber is effected when the crankcase pressure rises. The pressure conducted from the crankcase to the injection pump can be automatically regulated as a function of the rotational speed and/or load conditions of the engine.

23 Claims, 7 Drawing Figures

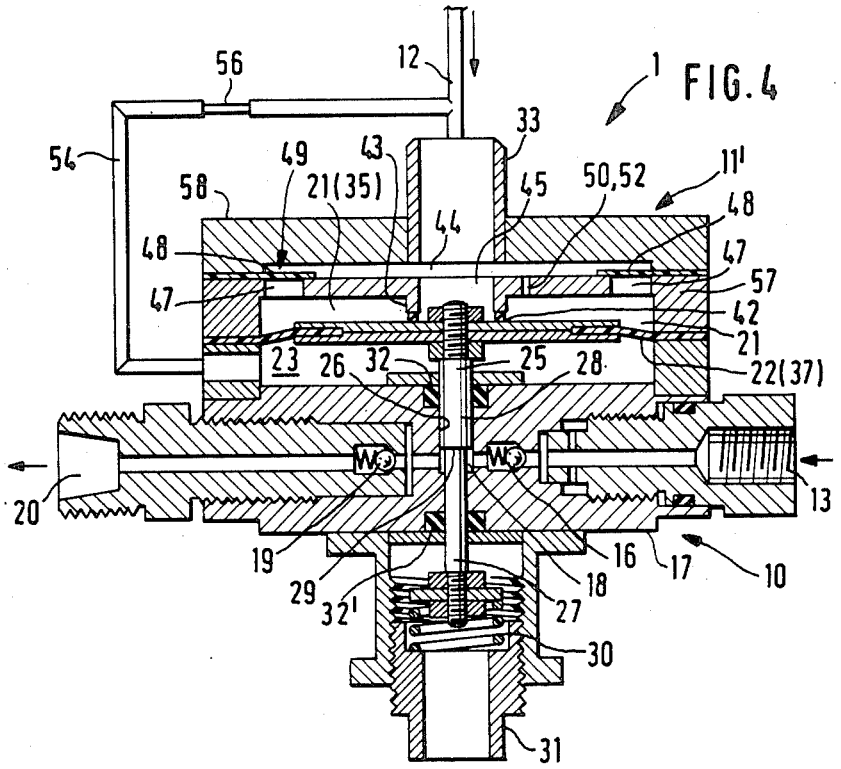
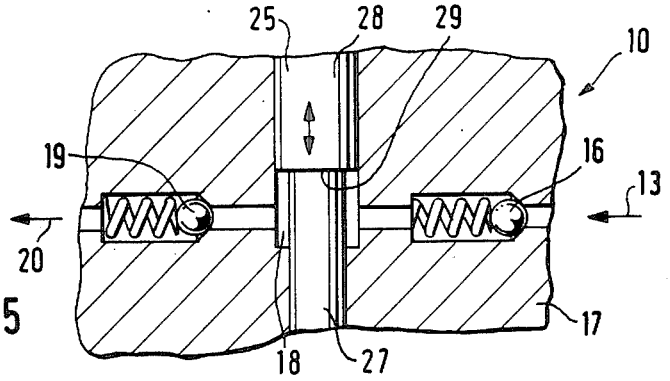
FIG. 5

METHOD OF INJECTING FUEL FOR TWO-STROKE ENGINE AND APPARATUS THEREFOR

FIELD OF THE INVENTION

The invention relates to a method for injecting fuel in two-stroke engines, in particular for hand-held portable tools such as motor-driven saws and the like. An apparatus for performing the method is also disclosed. In the method and apparatus, the pressure present in the crankcase of the engine is applied to the injection pump and fuel is supplied in dependence thereon for injection and combustion.

BACKGROUND OF THE INVENTION

In hand-held portable motor-driven saws, used for removing branches from trees for instance, high-speed operation at approximately 9,000 to 12,000 rpm is typical. On the other hand, in felling trees, rotational speeds of approximately 6,000 to 9,000 rpm are used for maximum cutting power. The idling rotational speed is approximately 2,000 to 3,000 rpm. German published and examined patent application DE-AS No. 22 48 584 discloses a two-stroke engine in which the fuel is aspirated by the injection pump with increasing pressure in the crankcase and then, as the crankcase pressure increases further, the fuel is pumped so as to be injected into the combustion chamber. However, a satisfactory adaptation of the instant of injection to the particular rpm is not obtained. The injection event itself, that is, injection of the fuel into the combustion chamber of the engine, should preferably take place approximately when the piston is in the vicinity of bottom dead center. At relatively high engine speeds, however, there are delays because it takes a certain amount of time for the air pressure to reach the injection pump from the crankcase. The movement of the pump piston in the injection pump takes still more time. Even further delay is occasioned by the distance the fuel is pumped.

At high rpm, these delays are so major that even though the injection event was triggered in the vicinity of bottom dead center, the actual onset of injection occurs only just before top dead center of the piston. The end of the injection event is thus delayed still further, until the end of injection extends past top dead center and occurs while combustion is already taking place, resulting in poor efficiency. These delays occurring at high speeds mean that optimal combustion no longer takes place; individual combustion events may be entirely absent and the overall operating cycle of the two-stroke engine at various speeds is disrupted.

SUMMARY OF THE INVENTION

It is an object of the invention to provide a method of the kind described above wherein the fuel quantity pumped is always injected at the correct instant in dependence upon the operating rotational speed (rpm) present at a particular time irrespective of how high the rpm is.

The method of the invention is for injecting fuel in a two-stroke engine for a hand-held portable tool such as a motor-driven saw or the like. The engine is equipped with a fuel injection pump and has a piston and cylinder conjointly defining a combustion chamber and a crankcase wherein pressure is developed in response to the movement of the piston. The method includes the steps of: conducting the pressure away from the crankcase and charging the fuel-injection pump therewith to pump the fuel in dependence thereon for injecting and burning the same in the engine; triggering the injection process and initiating the injection of fuel into the combustion chamber in response to an increase in the pressure; and, regulating the pressure conducted away from the crankcase in dependence upon at least one of the following: the rotational speed of the engine and the load on the engine.

It is also an object to provide an apparatus for carrying out the method of the invention.

BRIEF DESCRIPTION OF THE DRAWING

The invention will now be described with reference to the drawing wherein:

FIG. 4 is a section view of another embodiment of the apparatus of the invention wherein the injection pump is configured differently and includes an integral pilot valve;

FIG. 5 is an enlarged fragmentary section view of the differential piston and pump chamber as well as the associated check valves in the injection pump of FIGS. 1 to 3;

DESCRIPTION OF THE PREFERRED EMBODIMENTS OF THE INVENTION

Figure 6:
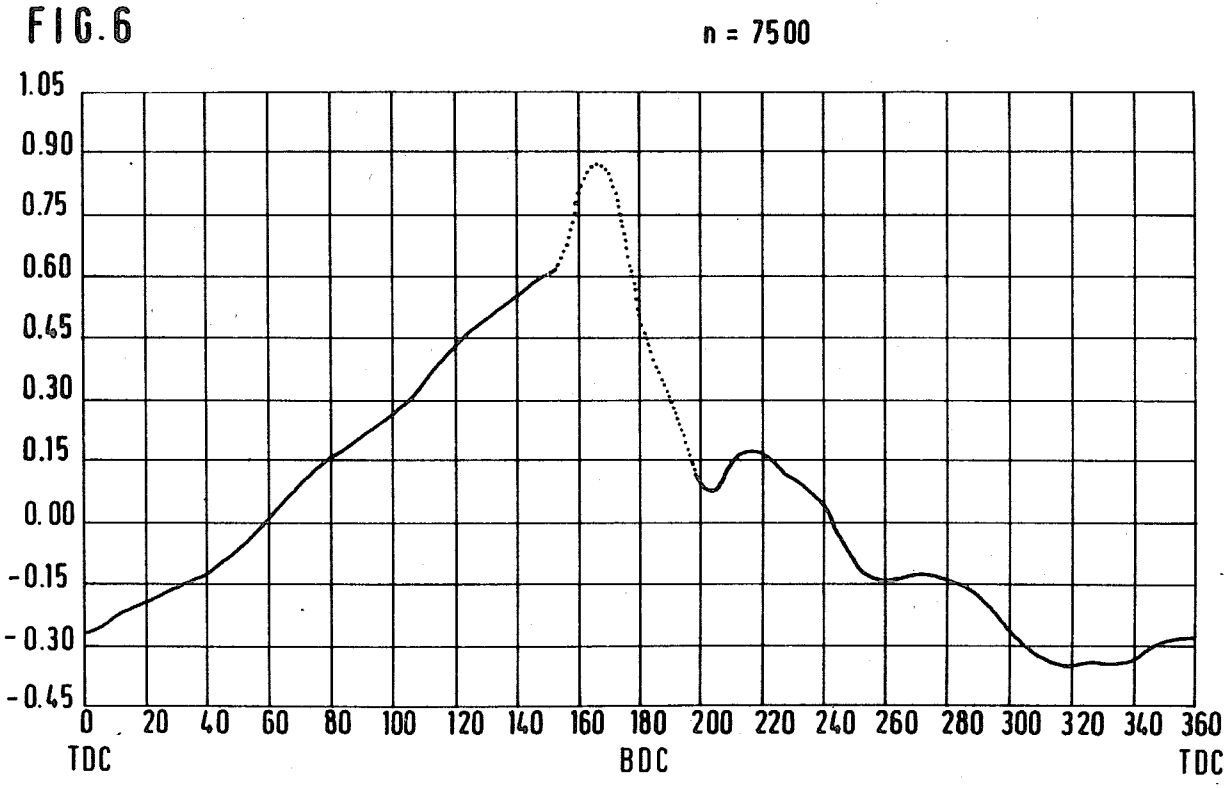
FIG. 6 is a diagram showing the course of pressure in the crankcase of the two-stroke engine; and, FIG. 7 is a circle diagram of one crankshaft revolution in the two-stroke engine.

The injection apparatus 1 according to the invention is intended for a two-stroke engine 2, which is used in particular in hand-held portable tools such as motor-driven saws and the like. The engine 2 has a cylinder 3, a piston 4, a combustion chamber 5, an injection nozzle 6, a crankcase 7 and a crankshaft 8 as well as a connecting rod 9 for the piston 4. During operation of the two-stroke engine 2, the pressure in the crankcase 7 varies as the piston 4 moves up and down, as shown in FIG. 6.

Figure 7:
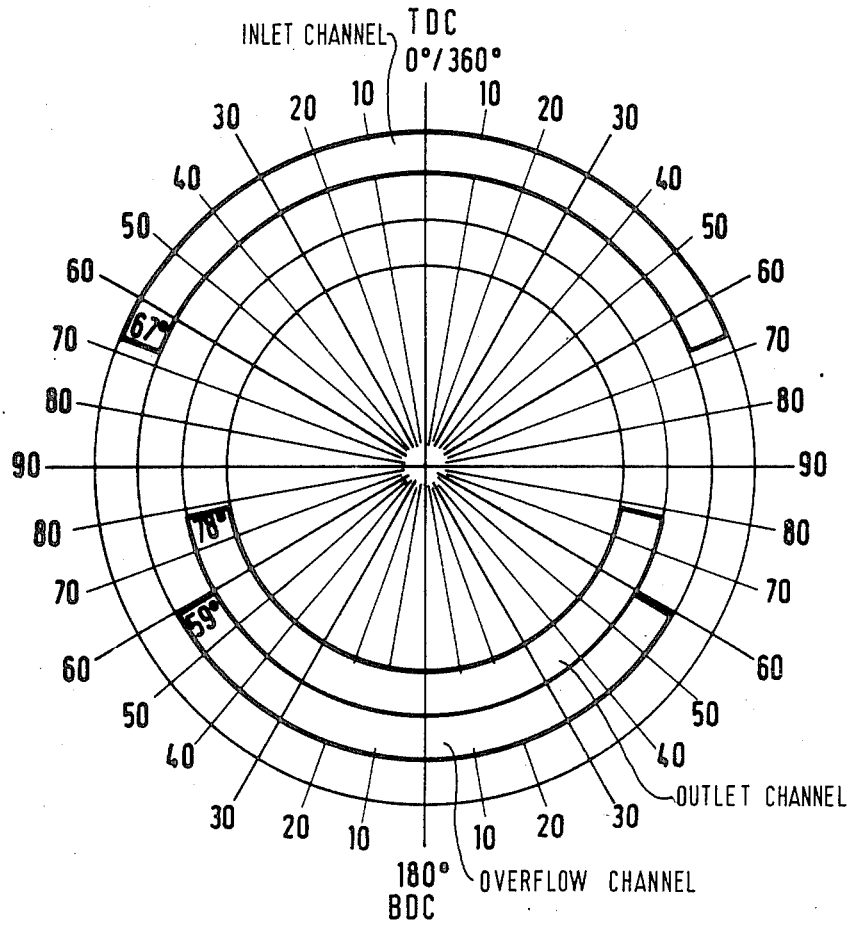

It is apparent that as the piston 4 moves downwardly from top dead center (TDC in FIGS. 6 and 7) to approximately bottom dead center (BDC in FIGS. 6 and 7), the pressure rises, producing an overpressure; then as the piston 4 moves upwardly, the pressure drops once again to such an extent that there is an underpressure in the crankcase 7. FIG. 7 also shows how the inlet conduit, the outlet conduit and the overflow conduit in the two-stroke engine 2 are controlled in the course of one 360° crankshaft revolution.

The injection apparatus 1 has an injection pump 10, a pilot valve 11 and a connecting line 12, which is connected to the crankcase 7 and conducts the pressure present there to the injection pump 10. A fuel supply line 13 is also connected to the injection pump 10. A feed pump 15 pumps fuel out of a tank 14 to an intake valve 16 configured as a check valve.

The intake valve 16 is located on one side of a pump chamber 18 formed in the housing 17 of the injection pump 10, while an outlet valve 19, likewise configured as a check valve, is located on the opposite side. An injection line 20 leads from this outlet valve 19 to the injection nozzle 6 of the two-stroke engine 2.

The connecting line 12 extending from the crankcase 7 leads to a pressure chamber 21 of the injection pump 10. The pressure chamber 21 is partitioned from an adjacent chamber 23 by a diaphragm 22. The chamber 23, in the embodiments of FIGS. 1 and 2, communicates with the ambient atmosphere through openings 24.

A pump piston 25 is secured in the middle of the diaphragm 22 and is supported such that it is capable of axial reciprocation in a guide bore 26 of the housing 17. FIG. 5 in particular shows that the pump piston 25 is configured as a differential piston, and to this end has an axial extension in the form of a piston rod 27, the diameter of which is less than the diameter of the piston portion 28. The piston portion has the annular piston face 29 formed as a piston step in the vicinity of the pump chamber 18. The piston rod 27 having the thinner cross section extends through the pump chamber 18, and in the vicinity of its end it is acted upon by the force of a spring 30, which in this embodiment is in the form of a helical compression spring and acts in the axial direction of the pump piston 25 counter to the diaphragm 22. The force of the spring 30 is infinitely adjustable via a sleeve-like screw 31.

FIGS. 1 to 4 also show that the pump piston 25 is sealed off at its outer circumferential surface from the guide bore 26 by means of ring seals 32. The ring seals 32 may be made of elastomer and embodied as O-rings or as lip seals, for example. One ring seal 32 is associated with the piston portion 28 having the larger diameter, while the other ring seal 32' is associated with the piston rod 27 having the smaller diameter.

The pilot valve 11 of the injection apparatus 1 of the invention effects an automatic control of the pressure derived from the crankcase 7 and conducted to the injection pump 10 as a function of the rotational speed (rpm) and/or the load conditions of the two-stroke engine 2. For this purpose, the pilot valve 11 is arranged in the connecting line 12 in the region between the crankcase 7 and the injection pump 10. The pilot valve 11 has an inlet 33, where the part of the connecting line 12 coming from the crankcase 7 is connected, and an outlet 34, where the continuing portion of the connecting line 12 leading to the injection pump 10 is located.

Figure 1:
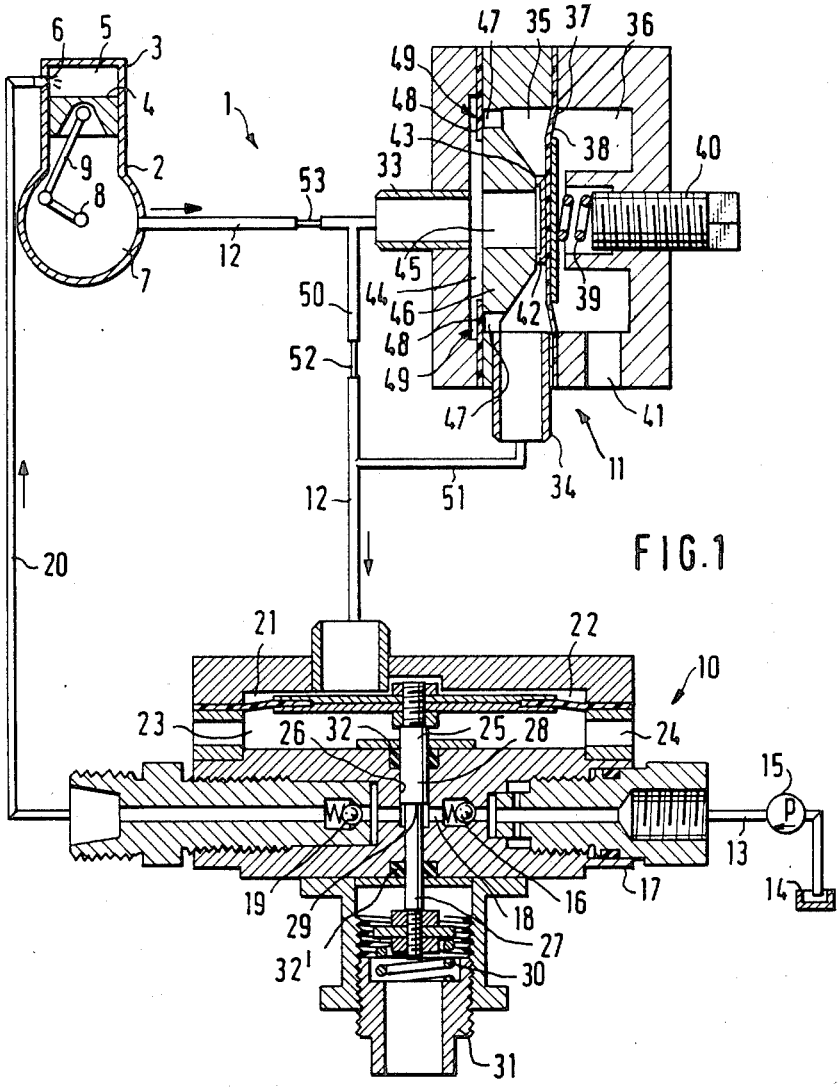
FIG. 1 is an overall view, in section, of an injection apparatus according to the invention, the apparatus including an injection pump and a pilot valve.

An annular chamber 35 and a further chamber 36, which are partitioned from one another by a sealing diaphragm 37, are provided in the pilot valve 11. On its rearward side 38 facing the chamber 36, the sealing diaphragm 37 is acted upon by the force of a spring element 39, which is shown here in the form of a helical compression spring and is infinitely adjustable by means of a threaded bolt 40. In the embodiment of FIG. 1, the chamber 36 communicates with the ambient atmosphere through an opening 41.

On the side of the sealing diaphragm 37 opposite the rearward side 38, there is a sealing plate 42, which rests on a valve seat 43 from which it can be lifted. The valve seat 43 is approximately conical and protrudes into the annular chamber 35. The annular chamber 35 communicates with the outlet 34.

Figure 2:
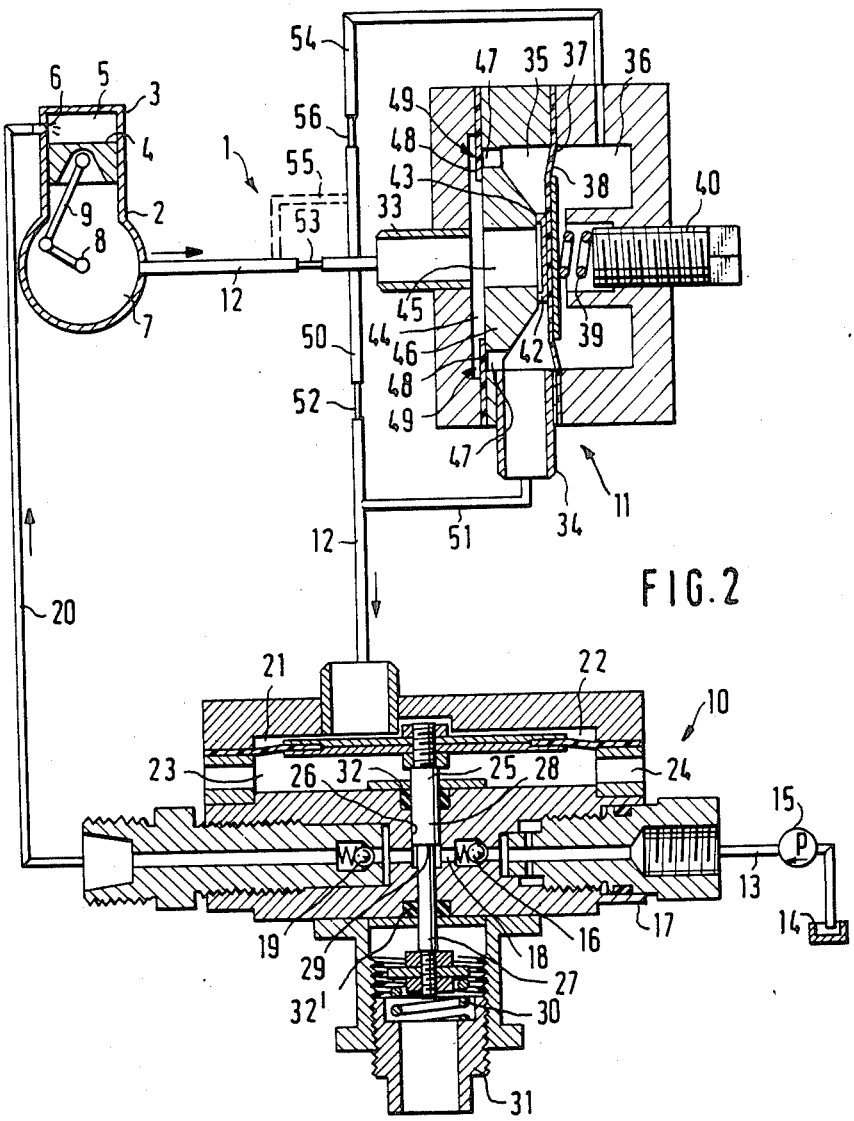
FIG. 2 shows another embodiment of the injection apparatus according to the invention, which is similar to that of FIG. 1 but has an additional means of controlling the pilot valve via the mean crankcase pressure.

Adjacent to the inlet 33 in the pilot valve 11 is a forechamber 44, which is part of the inlet chamber 45 leading to the valve seat 43. FIGS. 1 and 2 show that through bores 47 are formed in the wall 46 located between the annular chamber 35 and the forechamber 44. On the side of the through bores 47 located opposite the annular chamber 35, that is, on the side of the wall 46 facing the forechamber 44, there are check flaps 48, which may preferably be made of an elastic material and which by the resilience inherent in this material close off the through bores 47 toward the annular chamber 35. However, when there is an overpressure in the annular chamber 35, the check flaps 48 open up the through bores 47 toward the forechamber 44. Check valves 49 are thereby provided in the pilot valve 11 which open in a direction toward the inlet chamber 45 when there is an overpressure in the annular chamber 35.

Figure 3:
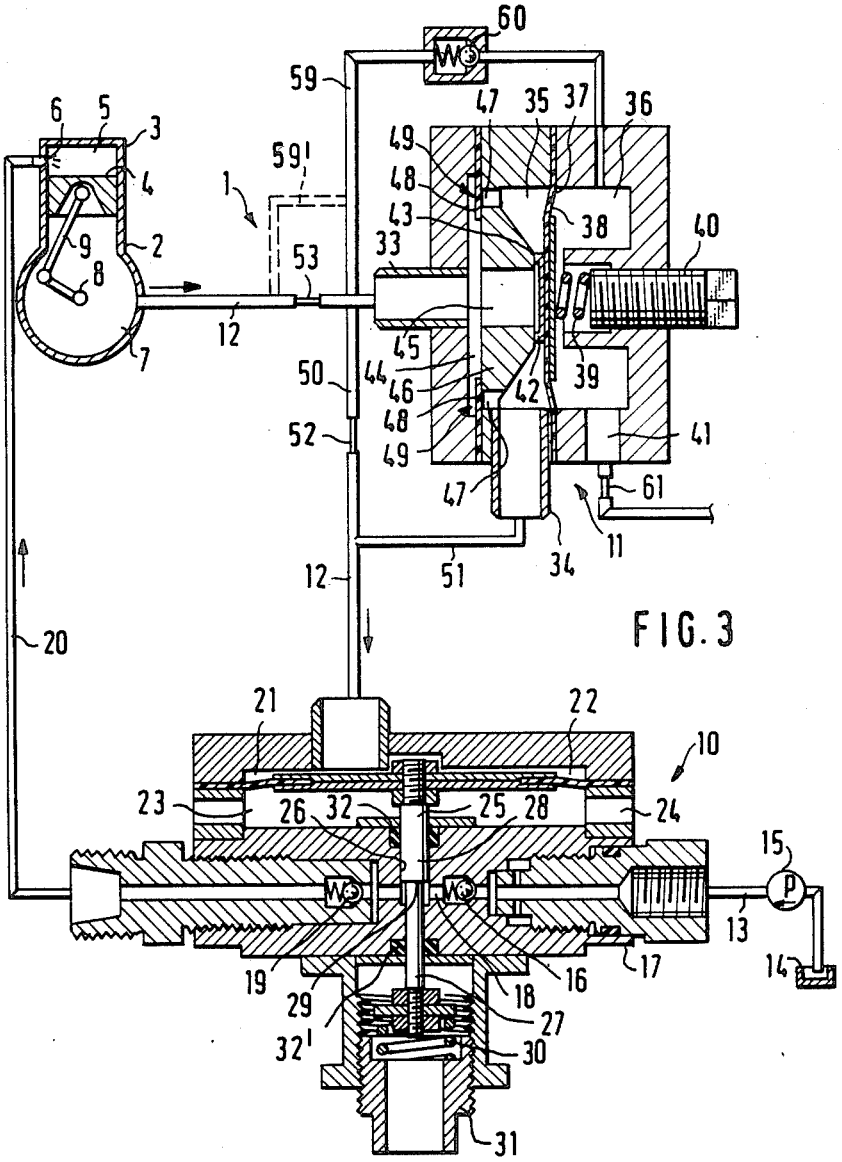
FIG. 3 shows still another injection apparatus according to the invention, similar to that of FIG. 2.

FIGS. 1 to 3 also show a bypass 50, which branches off from the connecting line 12 ahead of the inlet 33 to the pilot valve 11 and is joined to the line segment 51 leading away from the outlet 34 of the pilot valve 11, thereby practically bypassing the pilot valve 11 in that the pressure deriving from the crankcase 7 reaches the injection pump 10 through the bypass 50. A throttle 52 is provided in the bypass 50 for substantially blocking off the crankcase pressure at high engine speed, so that the pressure is then directed through the pilot valve 11. The substantially lower pressure, which also builds up more slowly and occurs in the crankcase 7 at idling rpm of the two-stroke engine 2, is passed through by the throttle 52, so that the crankcase pressure at idling rpm is conducted directly to the pressure chamber 21 of the injection pump 10 bypassing the pilot valve 11.

FIGS. 1 to 3 also show that an inlet throttle 53 is provided in the portion of the connecting line 12 leading from the crankcase 7, ahead of the inlet 33 of the pilot valve 11 and ahead of the branching point of the bypass 50; this inlet throttle 53 reduces the crankcase pressure in the high-speed range of the engine prior to its entry into the pilot valve 11, which prevents the pumping of excessive fuel at the highest rpm levels.

In the injection method according to the invention, the injection event is triggered and the beginning of the injection into the combustion chamber 5 of the two-stroke engine 2 occurs at increasing crankcase pressure; that is, the piston 4 is moving downwardly from top dead center. When the crankcase pressure "0" is exceeded, which happens at approximately 60° after top dead center, the injection event is triggered. The triggering is brought about because the crankcase pressure is exerted upon the diaphragm 22, counter to the force of the spring 30 in the injection pump 10, and axially displaces the pump piston 25, so that the piston face 29 forces the fuel located in the pump chamber 18 through the outlet valve 19, the injection line 20 and the injection nozzle 6 into the combustion chamber 5. The actual injection event, in which the fuel is thus ejected from the injection nozzle 6 into the combustion chamber 5, takes place approximately at bottom dead center of the piston 4.

In the follow-on upward movement of the piston from bottom dead center to top dead center, the pressure in the crankcase 7 drops. When the crankcase pressure of "0" is passed through, approximately after 240° of crankshaft rotation, an underpressure develops in the crankcase 7 which causes the diaphragm 22 to shift into the position shown and thus, as shown, pulls back the pump piston 25. With the return movement of the pump piston 25, an underpressure is established in the pump chamber 18, so that the intake valve 16 opens and fuel can flow into the pump chamber 18. The fuel is thus drawn in by suction during the underpressure phase in the crankcase 7, while the triggering of the injection event and the injection itself take place when the crankcase pressure is rising.

With increasing rpm, the absolute time for one crankshaft revolution becomes shorter, while the delay duration from the triggering of the injection event until the actual injection remains the same. This means that within this time, a greater angle of crankshaft revolution is passed through by the piston 4. In other words, in two-stroke engines according to the prior art, the delay durations can be deleterious at higher rpm levels, while in the method according to the invention this disadvantage is overcome by the automatic rpm-dependent control, because at high rpm the triggering of the injection event takes place at approximately 90° after top dead center. In the embodiment shown, the differential piston 25 plunges with its piston face 29 into the pump chamber 18 at about 70° after top dead center and pumps the fuel through the outlet valve 19 to the injection nozzle 6. Because of the structurally dictated delay in the injection system, the actual injection of the fuel into the combustion chamber 5 then takes place, at a high speed of over 9,000 rpm, at approximately the instant when the piston is located at bottom dead center. The piston travel from bottom dead center to approximately 30° before top dead center is then available for mixture preparation and compression. The ignition of the fuel mixture takes place at approximately 30° before top dead center, so that in this embodiment optimal compression, turbulence and preparation of the fuel-air mixture are assured even at maximally high rpm.

The additional embodiment of the pump piston 25 as a differential piston furthermore assures exact metering of the fuel quantity to be injected.

At low rpm levels, the piston speed is lower and the piston 4 thus travels a shorter distance per unit of time than at higher rpm levels, so that the delay cannot have such a pronounced effect. To prevent the actual injection event from occurring prior to bottom dead center and causing an overlap between the combustion event that is already taking place and the follow-on injection event, the pilot valve 11 is provided for the self-actuating control; this valve 11 blocks the transfer of crankcase pressure to the injection pump as a function of rpm until such time as the crankcase pressure has attained a certain predetermined threshold. As a result, the triggering event or the initiation of the injection (that is, the plunging of the piston face 29 into the pump chamber 18) does not occur as soon as 90° after top dead center, but rather occurs at some later time, for instance 110° after top dead center. As a result, given the injection system delay associated with this rpm level, the actual injection once again optimally takes place in the region of bottom dead center.

The threshold value for triggering the injection event can be precisely predetermined by means of the force of the spring element 39 in the pilot valve 11 by rotating the threaded bolt 40. If the pressure derived from the crankcase 7 and present in the inlet chamber 45 of the pilot valve 11 exceeds the threshold that has been set, then the sealing diaphragm 37 lifts away from the valve seat 43, and the pressure reaches the annular chamber 35. The pressure is thereupon immediately exerted upon the entire surface area of the sealing diaphragm 37, so that because of the larger operative surface, the valve seat 43 is uncovered rapidly. After the rapid opening when the set threshold value is exceeded, the pressure is again conducted through the line segment 51 at the outlet 34 back to the connecting line 12 and on to the pressure chamber 21 of the injection pump 10. Because of the pilot valve 11 described here, the sealing diaphragm 37 thus does not rise from the valve seat 43 until a predetermined pressure threshold is reached, enabling the transfer of pressure, as a result of which the triggering for the working stroke of the pump piston 25, for the injection of the fuel, is delayed by approximately 20° of crankshaft revolution; thus, the injection event is triggered at approximately 110° after top dead center, and the injection itself occurs in the vicinity of bottom dead center, as desired.

For adaptation to various rpm levels, the check valve 49 is provided inside the pilot valve 11. The through bores 47 of the check valve 49 have a small cross section and therefore act as throttles. If there is an underpressure in the crankcase 7, the annular chamber 35 in the pilot valve 11 is evacuated via the check valves 49. When the crankcase pressure rises again, the vacuum continues to be maintained in the annular chamber 35, because the check flaps 48 block the through bores 47 in this direction. The underpressure present in the annular chamber 35 reinforces the spring element 39, so that the sealing diaphragm 37 is pressed with increased force against the valve seat 43. Consequently, the sealing plate 42 is lifted from the valve seat 43 only at higher crankcase pressures, and the injection event is delayed to an increased extent.

Because the through bores 47 of the check valve 49 are configured as throttles, the underpressure which builds in the annular chamber 35 is not the same at all rpm levels and is instead different at different rpm levels. At high rpm, the throttling effect of the through bores 47 is very intensive; that is, at high rpm only a slight underpressure, or even none at all, occurs in the annular chamber 35. The spring element 39 is thus reinforced only slightly or not at all, so that the sealing diaphragm 37 can rise from the valve seat 43 relatively early thereby enabling the transfer of pressure. At low rpm levels, significantly more time is available for evacuating the annular chamber 35. The effect is that a more pronounced underpressure develops which greatly reinforces the spring element 39, so that the sealing plate 42 is pressed tightly against the valve seat 43 and does not lift from the valve seat 43 until a later point in time when there is a high crankcase pressure. The actual self-actuating adaptation of the injection system to the various rpm levels of the two-stroke engine 2 is thereby attained. The spring element 39 itself is actually only a means of effecting a certain pre-adjustment which is not dependent on rpm. The rpm dependency is attained by means of the variable pressure drop, or variable buildup of underpressure occurring in the annular chamber 35 at various rpm levels.

Since the pressures in the crankcase 7 are very low when the two-stroke engine 2 is idling, the route for transferring pressure through the pilot valve 11 is closed. However, to enable injection even during idling, a further embodiment of the invention provides for the throttle 52 in the bypass 50. This throttle 52 is configured such that at relatively high rpm the pressure is conducted virtually exclusively via the pilot valve 11, while at lower rpm levels, because of the slow buildup of pressure and the low crankcase pressure, this pressure is conducted through the throttle 52 directly into the pressure chamber 21 of the injection pump 10. This assures that sufficient fuel will be pumped during idling.

The inlet throttle 53, disposed in the part of the line leading from the crankcase 7, is provided for the maximum rpm range. The line cross sections are normally selected such that adequate air, that is pressure, reaches the injection pump 10. At a relatively high rpm, however, it may happen that too much fuel is pumped. The inlet throttle 53 prevents this. It is configured such that above approximately 10,000 rpm, the air pressure in the connecting line 12 is throttled, so that the injection pump 10 will pump a lesser quantity than without the throttle, which prevents excessive fuel consumption during operation of the two-stroke engine 2.

The embodiment of FIG. 2 includes a further improvement for a self-actuating control of the injection system, in that the chamber 36 of the pilot valve located opposite the annular chamber 35, on the other side of the sealing diaphragm 37, is not open to the ambient atmosphere and is instead closed. An additional line 54 is also provided, which branches off from the connecting line 12 downstream of the inlet throttle 53 and leads into the chamber 36. The line 54 may also branch off from the connecting line 12 upstream of the inlet throttle 53, however, as indicated by the line segment 55 shown in broken lines. A control throttle 56 is disposed in the line 54 branching off to the chamber 36.

By this means, the pilot valve 11 is opened as a function of the mean crankcase pressure because it is not atmospheric pressure which is conducted into the chamber 36, but rather the mean pressure which adjusts itself in the crankcase 7. This has the advantage that at high load, that is, when the throttle flap of the two-stroke engine 2 is fully open or at full load, a high pressure is available, which acts upon the sealing diaphragm 37 from the rearward side 38 and prevents it from rising from the valve seat until later; thus the triggering of the injection event likewise occurs only correspondingly later. At decreasing load, or at low load, the mean pressure in the crankcase 7 also decreases, so that the sealing diaphragm 37 is no longer held closed too intensively and accordingly can open earlier. This enables a load-dependent control of the injection pump 10. The control throttle 56 is configured such that it generates, or admits, the mean pressure of the pressure arriving from the crankcase 7, and allows this mean pressure to reach the rearward side 38 of the sealing diaphragm 37.

If the throttle flap of the two-stroke engine 2 is fully opened and the engine is operating at full load, then a higher pressure develops in the crankcase 7, reaching the chamber 36 through the connecting line 12, the line segment 55 and the control throttle 56. As a result, at full load the sealing diaphragm 37 is subjected to high pressure, and the closing force of the spring element 39 is reinforced by this overpressure. The sealing diaphragm 37 is accordingly raised from the valve seat 36 only once a correspondingly high pressure from the crankcase 7 travels through the inlet chamber 45 to act upon the sealing plate 42 of the sealing diaphragm 37. That is, if the two-stroke engine 2 is operating under load, then the pilot valve 11 is not opened until a relatively high pressure has been attained. The relatively high pressure prevailing in the chamber 36 is always lower than the peak pressure that occurs in the crankcase 7. If the throttle flap of the two-stroke engine 2 is closed and the power is accordingly less, then the mean pressure in the crankcase 7 drops as well, as does the pressure in the chamber 36 of the pilot valve, so that the relationship between the pressures prevailing on respective sides of the sealing diaphragm 37 and hence the opening of the sealing diaphragm 37 at low power of the two-stroke engine 2 are assured.

In the embodiment of FIG. 3, an additional line 59 or 59' having a check valve 60 is provided between the connecting line 12 and the chamber 36 on the rearward side 38 of the sealing diaphragm 37. The aperture 41 from the chamber 36 leading to ambient pressure can be embodied as a throttle 61 or, as shown here, it may have the throttle 61 in a tubular line segment.

In the compression stroke of the two-stroke engine 2, that is, during the upward movement of the piston 4, an underpressure is established in the crankcase 7. Via the connecting line 12, the additional line 59 or 59' and the check valve 60, the chamber 36 of the pilot valve 11 is thereby evacuated, and so an underpressure is built up there as well. This underpressure acts upon the sealing diaphragm 37 counter to the spring force of the adjusting spring 39. As a result, the valve seat 43 is closed with a lesser total force, and consequently is opened even at slight overpressures in the inlet chamber 45. The underpressure in the chamber 36 of the pilot valve 11 thus brings about a partial suspension of the shift in injection timing at high rpm levels.

At low rpm levels, the chamber 36 of the pilot valve 11 is again filled with ambient air via the throttle 61 and the aperture 41, as soon as the check valve 60 is closed by the rising crankcase pressure during the working stroke. The underpressure in the chamber 36 is thereby eliminated entirely or in part, so that the adjusting spring acts substantially alone on the rearward side 38 of the sealing diaphragm 37. The adjusting effect of the adjusting spring 39 on the time of injection thus remains unaffected at low rpm levels, and the triggering of the injection event is delayed.

Accordingly, because of this configuration, the opening pressure of the sealing plate 42 is influenced as a function of rpm, so that rpm-dependent control of the instant of injection is provided.

FIG. 4 shows an embodiment in which the pilot valve 11' is integral with the injection pump 10, or in other words is structurally combined with it to make a single unit, substantially simplifying the structure. A particularly favorable feature is that the diaphragm 22 of the injection pump 10 simultaneously acts as the sealing diaphragm of the pilot valve 11'.

FIG. 4 shows that the valve seat 43, the inlet chamber 45, the throttling through bores 47 of the check valve 49 and the throttling bypass 50 of the integrated pilot valve 11' are embodied in the bottom 57 of the annular pressure chamber 21 of the injection pump 10. Adjoining the bottom 57 of the injection pump 10 is a valve housing 58 of the pilot valve 11', which defines the forechamber 44 in which the check flaps 48 that block the through bores 47 are located. The inlet 33 into which the part of the connecting line 12 leading from the crankcase 7 discharges is disposed on the valve housing 58, upstream of the forechamber 44. The additional line 54 branching off from the connecting line 12 and in which the control throttle 56 is provided leads into the chamber 23, which is separated from the pressure chamber 21 of the injection pump 10 by the diaphragm 22; in the embodiment shown in FIG. 4, the chamber 23 does not have an opening to the ambient atmosphere.

The operation of the embodiment according to FIG. 4 will now be explained.

The pressure coming from the crankcase 7 passes through the inlet 33 and the forechamber 44 into the inlet chamber 45. Here, the pressure acts upon the diaphragm 22 in the vicinity of the valve seat 43; because of the seal 42, the diaphragm 22 rests seal tight on the valve seat. Given appropriate pressure conditions, the diaphragm 22 lifts from the valve seat 43 whenever the pressure in the inlet chamber 45 is greater than the pressure exerted on the pump piston 25 by the spring 30 of the injection pump 10. The crankcase pressure then reaches the pressure chamber 21 and acts upon the entire surface of the diaphragm 22. As a result, the pump piston 25 connected with this diaphragm 22 is displaced axially, counter to the force of the spring 30, and performs a pumping stroke in which the piston face 29 of the differential piston forces the fuel located in the pump chamber 18 through the outlet valve 19 and the injection line 20 to the injection nozzle 6 and into the combustion chamber 5 of the two-stroke engine 2.

As the crankcase pressure drops, the diaphragm 22 is first moved back again until it is against the valve seat 43. As the crankcase pressure continues to drop, the through bores 47 are opened by the lifting of the check flaps 48, so that the pressure in the pressure chamber 21 can decrease and an underpressure can develop; this supplements the force of the spring 30 in pressing the diaphragm 22 against the valve seat 43. Then when the crankcase pressure rises again, the diaphragm 22 is pressed against the valve seat 43 with increased force because of the force of the spring 30 and the underpressure present in the pressure chamber 21; thus the opening of the pilot valve 11' and hence the triggering of the injection event only first take place at a suitable later time. The bypass 50 configured as a bore simultaneously functions as the throttle 52, which as in the above-described embodiments is provided for idling operation at low crankcase pressure.

A substantial advantage of the embodiment shown in FIG. 4 is its compact configuration. The injection pump 10 and the pilot valve 11' are combined into a unit which permits one sealing diaphragm to be dispensed with because the diaphragm 22 of the injection pump 10 also serves as the sealing diaphragm of the pilot valve 11'. In the embodiment of FIG. 4, the control of the injection system is accomplished as in the embodiment of FIG. 2 by means of the mean pressure of the crankcase 7. For this purpose, the additional line 54 branching off from the connecting line 12 and extending into the chamber 23 is provided with the control throttle 56.

It is understood that the foregoing description is that of the preferred embodiments of the invention and that various changes and modifications may be made thereto without departing from the spirit and scope of the invention as defined in the appended claims.

What is claimed is:

1. A method of injecting fuel in a two-stroke engine for a hand-held portable tool, the engine being equipped with a fuel injection pump having a diaphragm and having a piston and cylinder conjointly defining a combustion and a crankcase wherein pressure is developed in response to movement of the pistion, the method comprising the steps of:

conducting said pressure away from said crankcase and charging the fuel-injection pump therewith to pump the fuel in dependence thereon for injecting and burning the same in the engine;

triggering the injection process and initiating the injection of fuel into the combustion chamber in response to an increase in said pressure; and, regulating the pressure conducted away from said crankcase which acts directly on said diaphragm in dependence upon at least one of the following: the rotational speed of the engine and the load on the engine.

2. The method of claim 1, wherein the increasing pressure derived from the crankcase is released to the fuel injection pump only after a predeterminable threshold value has been exceeded.

3. The method of claim 1, wherein the injection process is triggered and the initiation of the injection of fuel is controlled by the mean value of said crankcase pressure.

4. An apparatus for injecting fuel in a two-stroke engine for hand-held portable tools, the engine having a piston and a cylinder conjointly defining a combustion chamber and having a crankcase wherein pressure is developed in response to the movement of the piston, the apparatus comprising:

a fuel-injection pump including: a housing defining an enclosed space; a diaphragm partitioning said enclosed space into a pressure chamber and a further chamber; and, pumping means operatively connected to said diaphragm for pumping fuel to said combustion chamber;

a line connecting the crankcase to said pressure chamber so as to permit said pressure in said crankcase to act upon said diaphragm; and, self-actuating control means arranged in said line for controlling the pressure acting directly upon said diaphragm.

5. The apparatus of claim 4, said self-actuating control means being integrated into said fuel-injection pump to conjointly define a single component therewith.

6. An apparatus for injecting fuel in a two-stroke engine for hand-held portable tools, the engine having a piston and a cylinder conjointly defining a combustion chamber and having a crankcase wherein pressure is developed in response to the movement of the piston, the apparatus comprising:

a fuel-injection pump including: a housing defining an enclosed space; a diaphragm partitioning said enclosed space into a pressure chamber and a further chamber; and, pumping means operatively connected to said diaphragm for pumping fuel to said combustion chamber;

a line connecting the crankcase to said pressure chamber so as to permit said pressure in said crankcase to act upon said diaphragm;

self-actuating control means arranged in said line for controlling the pressure acting upon said diaphragm; and, said pumping means including: a pump chamber formed in said housing; and, a pump piston connected to said diaphragm and movably mounted in said housing on a side of said diaphragm facing away from said pressure chamber, said piston being configured as a differential piston having an annular piston surface facing toward said pump chamber and having a piston rod extending out from said piston surface so as to pass through said pump chamber, said piston rod having a diameter less than the remainder of said piston.

7. The apparatus of claim 6, said housing defining a bore for accommodating said differential piston therein, said differential piston being displaceably mounted in said bore for movement therein in correspondence to the movement of said diaphragm; and, said pumping means including sealing means for sealing said differential piston with respect to said pump chamber.

8. The apparatus of claim 6, comprising adjusting means for resiliently biasing said differential piston in a direction against said diaphragm.

9. The apparatus of claim 8, said adjusting means including an adjusting screw and a spring interposed between said screw and said differential piston, said spring acting on said differential piston on the end thereof facing away from said diaphragm.

10. The apparatus of claim 9, said adjusting screw being a sleeve-like member threadably engaging said housing.

11. An apparatus for injecting fuel in a two-stroke engine for hand-held portable tools, the engine having a piston and a cylinder conjointly defining a combustion chamber and having a crankcase wherein pressure is developed in response to the movement of the piston, the apparatus comprising:

a fuel-injection pump including: a housing defining an enclosed space; a diaphragm partitioning said enclosed space into a pressure chamber and a further chamber; and, pumping means operatively connected to said diaphragm for pumping fuel to said combustion chamber;

a line connecting the crankcase to said pressure chamber so as to permit said pressure in said crankcase to act upon said diaphragm; and, self-actuating control means arranged in said line for controlling the pressure acting upon said diaphragm, said self-actuating control means including a pilot valve connected into said line between said crankcase and said fuel-injection pump.

12. The apparatus of claim 11, said pilot valve having an inlet and an outlet, said line having a first line length connecting said crankcase to said inlet and a second line length for connecting said outlet to said fuel-injection pump; said pilot valve including a pilot-valve housing defining an entry chamber communicating with said inlet, said housing having a valve seat communicating with said entry chamber, said pilot valve further including a sealing diaphragm mounted in said pilot-valve housing so as to be movable between a first position whereat said sealing diaphragm is in sealing contact with said valve seat and a second position whereat said sealing diaphragm is lifted from said valve seat when said pressure in said crankcase exceeds a pressure threshold value, said pilot-valve housing and said diaphragm conjointly defining an outlet chamber communicating with said outlet and communicating with said inlet chamber when said sealing diaphragm is in said second position; and, said pilot valve further comprising adjustable spring means for resiliently biasing said sealing diaphragm into said first position thereof.

13. The apparatus of claim 12, said pilot valve being integrated into said fuel-injection pump to conjointly define a single component therewith, said diaphragm of said fuel-injection pump being configured so as to be said sealing diaphragm of said pilot valve.

14. The apparatus of claim 12, said pilot valve comprising check valve means for opening in the direction toward said entry chamber in response to an overpressure in said outlet chamber.

15. The apparatus of claim 14, said pilot-valve housing including a partition wall between said entry chamber and said outlet chamber, said check valve means comprising through bores formed in said partition wall and extending between said entry chamber and said outlet chamber; and, elastic check flaps mounted in said entry chamber on said partition wall at said through bores, respectively.

16. The apparatus of claim 15, said pilot-valve housing and said sealing diaphragm conjointly defining an ancillary chamber separated from said outlet chamber by said sealing diaphragm; and, said pilot valve including a passage formed in said pilot-value housing connecting said ancillary chamber with the ambient.

17. The apparatus of claim 16, comprising a throttle connected to said passage so as to be interposed between the ambient and said ancillary chamber, an additional line branching off from said first line length at a location ahead of said inlet for charging said ancillary chamber with the pressure in said crankcase; and, a check valve mounted in said additional line for closing in response to overpressure in said crankcase and opening in response to underpressure therein.

18. The apparatus of claim 15, said housing and said sealing diaphragm conjointly defining an andillary chamber separated from said outlet chamber by said sealing diaphragm, said ancillary chamber being tightly sealed with respect to the ambient, said apparatus further comprising an additional line branching off from said first length at a location ahead of said inlet for charging said ancillary chamber with the mean value of said pressure in said crankcase.

19. The apparatus of claim 18, comprising an input throttle connected in said first line length for reducing the pressure in said crankcase developed in the high-speed range of the engine, said additional line being connected into said first line length at one of the ends of said input throttle.

20. The apparatus of claim 19, comprising a control throttle connected into said additional line for passing the mean pressure developed in said crankcase.

21. An apparatus for injecting fuel in a two-stroke engine for hand-held portable tools, the engine having a piston and a cylinder conjointly defining a combustion chamber and having a crankcase wherein pressure is developed in response to the movement of the piston, the apparatus comprising:

a fuel-injection pump including: a housing defining an enclosed space; a diaphragm partitioning said enclosed space into a pressure chamber and a further chamber; and, pumping means operatively connected to said diaphragm for pumping fuel to said combustion chamber;

a line connecting the crankcase to said pressure chamber so as to permit said pressure in said crankcase to act upon said diaphragm;

self-actuating control means arranged in said line for controlling the pressure acting upon said diaphragm; and, bypass means bypassing said self-actuating control means, said bypass means including a first throttle for blocking the pressure from said crankcase produced in response to a high rpm of said engine and for passing to said pressure chamber the pressure from said crankcase produced in response to the idle rpm of said engine.

22. An apparatus for injecting fuel in a two-stroke engine for hand-held portable tools, the engine having a piston and a cylinder conjointly defining a combustion chamber and having a crankcase wherein pressure is developed in response to the movement of the piston, the apparatus comprising:

a fuel-injection pump including: a housing defining an enclosed space; a diaphragm partitioning said enclosed space into a pressure chamber and a further chamber; and, pumping means operatively connected to said diaphragm for pumping fuel to said combustion chamber;

a line connecting the crankcase to said pressure chamber so as to permit said pressure in said crankcase to act upon said diaphragm;

self-actuating control means arranged in said line for controlling the pressure acting upon said diaphragm; said self-actuating control means including a pilot valve connected into said line between said crankcase and said fuel-injection pump; and, an input throttle connected between said crankcase and said pilot valve for reducing the pressure in said crankcase developed in the high-speed range of the engine.

23. An apparatus for injecting fuel in a two-stroke engine for hand-held portable tools, the engine having a piston and a cylinder conjointly defining a combustion chamber and a crankcase wherein pressure is developed in response to the movement of the piston, the apparatus comprising:

a fuel-injection pump and pilot-valve unit including: a housing defining an enclosed space; and, a diaphragm partitioning said enclosed space into a pressure chamber and a further chamber; pumping means operatively connected to said diaphragm for pumping fuel to said combustion chamber; and, a pilot valve mounted in said housing and having an inlet communicating with said crankcase;

said pilot valve including: a partition wall adjacent said diaphragm for conjointly defining said pressure chamber therewith; said housing having a wall adjacent said partition wall to conjointly define an entry chamber therewith communicating with said inlet; a valve seat formed in said partition wall so as to face toward said diaphragm for coacting therewith; check valve means mounted on said partition wall for opening in the direction toward said entry chamber in response to an overpressure condition in said pressure chamber; and, throttling bypass means formed in said partition wall for blocking the pressure from said crankcase produced in response to a high rpm of said engine and for passing to said pressure chamber the pressure from said crankcase produced in response to the idle rpm of said engine; and, means connecting said crankcase to said further chamber for charging said further chamber with the mean value of said pressure in said crankcase.

* * * * *

UNITED STATES PATENT AND TRADEMARK OFFICE

CERTIFICATE OF CORRECTION

PATENT NO. : 4,700,668

DATED : October 20, 1987

INVENTOR(S) : Roland Schierling et al

It is certified that error appears in the above-identified patent and that said Letters Patent is hereby corrected as shown below:

In column 9, line 57: in front of "and" please insert -- chamber --.

In column 9, line 58: delete "pistion" and substitute -- piston -- therefor.

In column 12, line 8: delete "pilot-value" and substitute -- pilot-valve -- therefor.

In column 12, line 20: delete "andillary" and substitute -- ancillary -- therefor.

Signed and Sealed this

Fifteenth Day of March, 1988

*Attest:*

*Attesting Officer*

DONALD J. QUIGG

*Commissioner of Patents and Trademarks*